US005393560A

United States Patent [19]

Okada et al.

[11] Patent Number: 5,393,560

[45] Date of Patent: Feb. 28, 1995

[54] METHOD FOR PREPARING A HEAT-SENSITIVE RECORDING MATERIAL

[75] Inventors: Kiyomi Okada, Osaka; Gensuke Matoba, Ibaraki, both of Japan

[73] Assignee: Kanzaki Paper Mfg. Co., Ltd., Chuo, Japan

[21] Appl. No.: 98,238

[22] Filed: Jul. 29, 1993

Related U.S. Application Data

[63] Continuation of Ser. No. 848,422, Mar. 6, 1992, abandoned.

[30] Foreign Application Priority Data

Mar. 7, 1991 [JP] Japan ..... 3-041822

[51] Int. Cl.[6] ..... B41M 5/26

[52] U.S. Cl. ..... 427/150; 427/152; 427/411; 427/412.3; 427/412.5; 503/200; 503/207; 503/214; 503/226

[58] Field of Search ..... 503/200, 207, 226, 214; 427/150, 152, 411, 412.3, 412.5

[56] References Cited

U.S. PATENT DOCUMENTS

| | | | |
|---|---|---|---|
| 4,833,116 | 5/1989 | Yamori et al. | 503/200 |
| 4,882,310 | 11/1989 | Arai et al. | 503/207 |
| 4,946,823 | 8/1990 | Nakamura et al. | 503/200 |
| 4,987,118 | 1/1991 | Murata et al. | 503/200 |
| 5,035,954 | 7/1991 | Yonese et al. | 428/195 |
| 5,047,383 | 9/1991 | Hayashi et al. | 503/200 |
| 5,079,212 | 1/1992 | Ishida et al. | 503/200 |

*Primary Examiner*—Pamela R. Schwartz
*Attorney, Agent, or Firm*—Morgan & Finnegan

[57] ABSTRACT

A heat-sensitive recording material having a uniform protective layer on a heat-sensitive recording layer formed on a base sheet which is a plastic film or synthetic paper can be obtained without generating a barline, streak or scratch. The protective layer is formed on the heat-sensitive recording layer after adjusting Bekk smoothness (measured by TAPPI standard T479 om-81) of the heat-sensitive recording layer to 500~6,000 seconds, preferably 1,500~4,500 seconds.

8 Claims, No Drawings

METHOD FOR PREPARING A HEAT-SENSITIVE RECORDING MATERIAL

This is a continuation of application Ser. No. 07/848,422, filed on Mar. 6, 1992, now abandoned.

BACKGROUND OF THE INVENTION

The present invention relates to a method for preparing a heat-sensitive recording material in which a plastic film or synthetic paper is used as the base sheet, particularly to a method in which a protective layer can be formed on the recording layer without generating a bar-line, streak or scratch.

There have been well-known heat-sensitive recording materials utilizing the colorforming reaction between a colorless or pale colored basic chromogenic material and an organic or inorganic color developer, in which the two colorforming materials are thermally contacted each other to produce recorded images. These heat-sensitive recording materials have been used not only as the recording medium of heat-sensitive facsimiles and heat-sensitive printers, but also in the other various fields, such as magnetic heat-sensitive recording system, POS (point of sales) system, tickets, prepaid cards, commutation tickets and the like.

As described above the application has been broadened, and accordingly it has been increased to form a protective layer on the recording layer to improve the retainability of the recorded images. Further, there have been used in many cases as the base sheet not only paper but also such a sheet superior in shelf life as a plastic film or synthetic paper.

However, when a coating composition is applied on a heat-sensitive recording layer of a heat-sensitive recording material, in which a plastic film or synthetic paper is used as the base sheet, to form a protective layer, troubles such as bar-line, streak and scratch easily occur and quality of the product is very lowered. Accordingly, it is necessary to carefully control preparation and/or application of the protective coating composition.

Therefore, it is an object of the present invention to provide a method for producing a heat-sensitive recording material in which a film or a synthetic paper is used as the base sheet, without generating a bar-line, streak or scratch even though a protective layer is formed on the recording layer.

SUMMARY OF THE INVENTION

According to the invention, a heat-sensitive recording material having a uniform protective layer on a heat-sensitive recording layer formed on a base sheet which is a plastic film or synthetic paper can be obtained. The protective layer is formed on the heat-sensitive recording layer after adjusting Bekk smoothness (measured by TAPPI standard T479om-81) of the heat-sensitive recording layer to 500 ~6,000 seconds, preferably 1,500~4500 seconds.

DETAILED DESCRIPTION OF THE INVENTION

Generally, in a heat-sensitive recording material in which a plastic film or synthetic paper is used as a base sheet, Bekk smoothness of the heat-sensitive recording layer formed on the base sheet becomes at least 7,000 seconds because of the smoothness of the base sheet. When a coating composition is applied on the heat-sensitive recording layer having such a high smoothness to form a protective layer, a streak or th like easily occurs as described above. On the other hand, when a coating composition is applied on the heat-sensitive recording layer having Bekk smoothness of a few hundred seconds to obtain a protective layer, the smoothness of the protective layer, namely the surface of the heat-sensitive recording material, is lowered so that a recording head and the surface of the heat-sensitive recording material can not be made closely into contact and accordingly a clear image can not be obtained. Further, such a trouble as scratching the recording surface may be generated.

The above troubles can be prevented by the method according to the present invention, in which a protective coating composition is applied on a heat-sensitive recording layer after adjusting Bekk smoothness of it to 500~6,000 seconds, preferably 1,500~4,500 seconds.

The Bekk smoothness of the heat-sensitive recording layer can be adjusted to the desired specific region by controlling the average particle size and used amount of pigments comprised in the heat-sensitive recording layer, or by using a selected binder in a specific amount to prepare the heat-sensitive recording layer.

In the invention in which a plastic film or synthetic paper is used as the base sheet, the base sheet has a very smooth surface and is not substantially impregnated with a coating composition for preparing the recording layer, different from usual cases in which paper is used as the base sheet. Accordingly, the smoothness of the recording layer formed on such a base sheet is remarkably varied by slightly changing the kind of pigment and binder comprised in the recording layer or the used amount of them. Therefore, Bekk smoothness of the recording layer can be easily controlled by selectively using materials for preparing it and controlling the used amount to obtain the desired advantages of the invention.

As the reaction systems for forming a recording layer, various methods have been known. In the invention, there may be used for example a combination of an iron salt of organic phosphates and a ligand compound or a combination of a diazonium salt, a coupler and a basic compound. Since particularly good effect can be obtained by the system in which a basic chromogenic material is used with a color developer, the following descriptions will be made based on the system.

Various combinations of colorless or pale colored basic chromogenic materials and inorganic or organic color developers have been described in many patent specifications and literature. As the basic chromogenic materials, there have been known such as triallyl methane chromogenic materials, diphenylmethane chromogenic materials, thiazine chromogenic materials, spiro chromogenic materials, lactam chromogenic materials, fluoran chromogenic materials, fluorene chromogenic materials and the like. As the color developers, there have been known such as aromatic carboxylic acids, phenol compounds, phenol resins and polyvalent metal salts thereof. Those chromogenic materials and color developers may be used in the invention. Each of them may be used solely or in combination.

The coating composition for heat-sensitive recording layer generally comprises at least one binder. As the binder, there are exemplified starches; celluloses; proteins; gum arabic; polyvinyl alcohols; water-soluble copolymer salts; copolymer emulsions; copolymer latices such as styrene-butadiene copolymer latex, urethane latex and the like; resins such as styrene resin, acrylic resin, styrene-butadiene resin, uretane resin and the like. In the invention, Bekk smoothness of the recording layer may be adjusted to 500~6000 seconds, preferably 1,500~4,500 seconds, by selecting or controlling the used binder and the amount. The used amount of the binder is generally 5~60 weight % (preferably 10~50 weight % and most preferably 15~40 weight %) based on the total solid of the coating composition. Further, among the above binders, styrene-butadiene copolymer latex, urethan latex, styrene-butadiene resin and urethane resin are most preferably used.

Additionally, if necessary, there may be added to the coating composition various additives such as heat-fusible materials, e.g., aliphatic acid amides, aliphatic esters, aliphatic ethers, aromatic esters, aromatic ethers and the like; lubricants, e.g., waxes, aliphatic acid metal salts, silicone oils and the like; dispersing agent; ultraviolet absorbers; defoaming agents; fluorescent dyes; coloring dyes and the like.

According to the invention, it is necessary to adjust the Bekk smoothness of the surface of recording layer before applying an protective layer to 500~6,000 seconds, preferably 1,500~4,500 seconds. To obtain such a smoothness, it is preferred to add at least one pigment to the coating composition for recording layer. Among the pigments, there are included kaolin, clay, talc, calcium carbonate, magnesium carbonate, calcined kaolin, titanium oxide, diatomaceous earth, finely divided silica anhydride, amorphous silica, activated clay and the like. Particularly, kaolin, calcium carbonate, calcined kaolin and amorphous silica are preferably used. The Bekk smoothness of the surface of recording layer is preferably adjusted by controlling the average particle size or used amount of the pigment. It is preferred to use pigments having an average particle size within the range of 0.5~4.0 μm (preferably 0.6~3.0 μm and most preferably 0.7~2.0 μm). The used amount of the pigments is generally 5~50 weight % (preferably 10~45 weight % and most preferably 15~40 weight %) based on the total solid of the coating composition.

Thus obtained coating composition is coated on a base sheet, namely a plastic film or synthetic paper, to form a heat-sensitive recording layer. As the plastic film, there may be used a drawn or undrawn plastic film of such as polystylene, polyethylene, polyvinyl chloride, polyvinylidene chloride, polypropylene, polyester, polyamide, polycarbonate, polyurethane and the like. A drawn plastic film of polypropylene, polyester, polyamide and polycarbonate is preferably used. As the synthetic paper, there may be used that made by a film method or fiber method with use of a plastic material as described above. Synthetic paper made by a film method with use of polypropylene, polyester, polyamide or polycarbonate is preferably used.

The coating apparatus for applying thus obtained coating composition on a base sheet to prepare a recording layer is not particularly limited. For example, the coating composition is applied in an amount of 2 to 12 g/m$^2$, preferably 3 to 10 g/m$^2$, on dry basis with a coater such as blade coater, bar coater or gravure coater, or a coating apparatus in which the coating composition is coated by gravure roll and then smoothened by a bar. It is most preferable to only apply the coating composition to prepare a recording layer having a desired Bekk smoothness, but the recording layer produced by applying the coating composition may be treated by a roughing roll to control the surface to the desired smoothness.

According to the invention, a protective coating composition is applied on thus obtained heat-sensitive recording layer having Bekk smoothness of 500~6,000 seconds, preferably 1,500~4,500 seconds. The protective layer is generally formed by coating a coating composition mainly containing a water-soluble polymer. As the used water-soluble polymer, there are exemplified polyvinyl alcohols having various saponification degree and polymerization degree, polyvinyl alcohols modified with acetacetyl group, carboxyl group, silicon and the like, acrylic resins, polyolefine resins and the like.

Further, to the protective coating composition, pigments or the other additives may be added according to usual methods. Generally, the protective coating composition is prepared to have a viscosity of 20~400 cps, more preferably 20~250 cps. As the coating machines, there may be used a bar coater or rod coater such as a metering bar (or rod), smooth bar (or rod), wire wound bar (or rod), grooved bar (or rod), hydrobar (or rod), blade-holder bar (or rod) and the like; and a blade coater such as trailing blade, pond blade, inverted blade, flexiblade, flooded nip blade, fountain blade, short dwell blade and the like. The coating composition may be coated by a gravure roll and then applied with a bar or rod to control the coated amount and to smooth the surface.

The used amount of the protective coating composition is generally controlled within the range of 0.5 to 20 g/m$^2$, preferably 1 to 10 g/m$^2$ on dry basis. Further, an antistatic layer or a protective layer may be formed on the back of the base sheet, and a primer layer may be formed between the base sheet and the heat-sensitive recording layer. There may be applied additional various known techniques in the art such as applying a pressure sensitive adhesive on the back of the base sheet.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

① Preparation of Dispersion A

The following composition was pulverized in a sand mill, and the pulverization was continued until an average particle size of 2μm.

| | |
|---|---|
| 3-(N-ethyl-N-isoamylamino)-6-methyl-7-phenylaminofluoran | 10 parts |
| dibenzyltelephthalate | 20 parts |
| 5% aqueous solution of methyl cellulose | 5 parts |
| water | 65 parts |

② Preparation of Dispersion B

The following composition was pulverized in a sand mill, and the pulverization was continued until an average particle size of 2 μm.

| | |
|---|---|
| 4-hydroxy-4'-isopropoxydiphenylsulfon | 30 parts |
| 5% aqueous solution of methyl cellulose | 5 parts |

-continued

| | |
|---|---|
| water | 65 parts |

③ Preparation of a recording layer

The following composition was mixed to obtain a coating composition.

| | |
|---|---|
| Dispersion A | 100 parts |
| Dispersion B | 100 parts |
| amorphous silica (average particle size: 1 μm) | 20 parts |
| styrene-butadiene copolymer latex (solid amount) | 30 parts |
| water | 75 parts |

The coating composition was coated by a gravure roll in an amount of 10 g/m$^2$ on dry basis on a polypropylene film of 60 g/m$^2$, treated by a rod (wire wound bar) coater arranged after the gravure roll to control the coated amount and to smooth the coated surface, and then dried to obtain a heat-sensitive recording material having a recording layer of 5 g/m$^2$ on dry basis. Bekk smoothness of the recording layer is shown in Table 1.

④ Preparation of a protective layer

A protective coating composition was prepared by mixing 50 parts of polyvinyl alcohol, 40 parts of kaolin and 300 parts of water, coated by a gravure roll on the recording layer, treated by a rod (wire wound bar) coater and then dried to obtain a heat-sensitive recording material having a protective layer of 4 g/m$^2$ on dry basis on the recording layer.

EXAMPLE 2

A heat-sensitive recording material having a protective layer was prepared in the same manner as in Example 1 except that 3-(N-ethyl-N-isobutylamino)-6-methyl-7-phenylaminofluoran was used instead of 3-(N-ethyl-N-isoamylamino)-6-methyl-7-phenylaminofluoran to prepare Dispersion A.

EXAMPLE 3

A heat-sensitive recording material having a protective layer was prepared in the same manner as in Example 1 except that 4,4-isopropylidenediphenol was used instead of 4-hydroxy-4'-isopropoxydiphenylsulfon to prepare Dispersion B.

EXAMPLE 4

A heat-sensitive recording material having a protective layer was prepared in the same manner as in Example 1 except that calcium carbonate (average particle size: 1 μm) was used instead of amorphous silica to obtain a coating composition for preparation of the recording layer.

EXAMPLE 5

A heat-sensitive recording material having a protective layer was prepared in the same manner as in Example 1 except that amorphous silica having a particle size of 1.5 μm was used instead of that having a particle size of 1 μm to obtain a coating composition for preparation of the recording layer.

EXAMPLE 6

A heat-sensitive recording material having a protective layer was prepared in the same manner as in Example 1 except that the used amount of amorphous silica was increased from 20 parts to 30 parts to obtain a coating composition for preparation of the recording layer.

EXAMPLE 7

A heat-sensitive recording material having a protective layer was prepared in the same manner as in Example 1 except that an urethane latex was used instead of styrene-butadiene copolymer latex to obtain a coating composition for preparation of the recording layer.

EXAMPLE 8

A heat-sensitive recording material having a protective layer was prepared in the same manner as in Example 1 except that the used amount of styrene-butadiene copolymer latex was decreased from 30 parts to 20 parts to obtain a coating composition for preparation of the recording layer.

EXAMPLE 9

A heat-sensitive recording material having a protective layer was prepared in the same manner as in Example 1 except that an acrylic resin was used instead of polyvinyl alcohol to prepare the protective layer.

Comparative Example 1

A heat-sensitive recording material having a protective layer was prepared in the same manner as in Example 1 except that the used amount of amorphous silica was decreased from 20 parts to 5 parts to obtain a coating composition for preparation of the recording layer.

COMPARATIVE EXAMPLE 2

A heat-sensitive recording material having a protective layer was prepared in the same manner as in Example 2 except that the used amount of amorphous silica was decreased from 20 parts to 5 parts to obtain a coating composition for preparation of the recording layer.

COMPARATIVE EXAMPLE 3

A heat-sensitive recording material having a protective layer was prepared in the same manner as in Example 3 except that the used amount of amorphous silica was decreased from 20 parts to 5 parts to obtain a coating composition for preparation of the recording layer.

COMPARATIVE EXAMPLE 4

A heat-sensitive recording material having a protective layer was prepared in the same manner as in Example 1 except that the used amount of amorphous silica was decreased from 20 parts to 10 parts to obtain a coating composition for preparation of the recording layer.

COMPARATIVE EXAMPLE 5

A heat-sensitive recording material having a protective layer was prepared in the same manner as in Example 4 except that the used amount of calcium carbonate was decreased from 20 parts to 10 parts to obtain a coating composition for preparation of the recording layer.

COMPARATIVE EXAMPLE 6

A heat-sensitive recording material having a protective layer was prepared in the same manner as in Example 7 except that the used amount of amorphous silica was decreased from 20 parts to 5 parts to obtain a coating composition for preparation of the recording layer.

COMPARATIVE EXAMPLE 7

A heat-sensitive recording material having a protective layer was prepared in the same manner as in Example 9 except that the used amount of amorphous silica was decreased from 20 parts to 5 parts to obtain a coating composition for preparation of the recording layer.

Comparative Example 8

A heat-sensitive recording material having a protective layer was prepared in the same manner as in Example 1 except that colloidal silica having an average particle size of 0.1 μm was used instead of amorphous silica to obtain a coating composition for preparation of the recording layer.

COMPARATIVE EXAMPLE 9

A heat-sensitive recording material having a protective layer was prepared in the same manner as in Example 1 except that amorphous silica having an average particle size of 0.5 μm was used instead of that having 1 μm to obtain a coating composition for preparation of the recording layer.

COMPARATIVE EXAMPLE 10

A heat-sensitive recording material having a protective layer was prepared in the same manner as in Example 1 except that the used amount of styrene-butadiene copolymer latex was increased from 30 parts to 60 parts to obtain a coating composition for preparation of the recording layer.

Comparative Example 11

A heat-sensitive recording material having a protective layer was prepared in the same manner as in Example 1 except that the used amount of styrene-butadiene copolymer 2latex was increased from 30 parts to 50 parts to obtain a coating composition for preparation of the recording layer.

Thus obtained 20 heat-sensitive recording materials were examined by the following methods. The results are shown in Table 1.

Bekk smoothness of recording layer

Bekk smoothness of recording layer before forming a protective layer was measured by TAPPI standard T479 om-81 .

Color density

The color density of the recorded image obtained by printing with a thermal printer (Mitsubishi SCTP-65 manufactured by Mitsubishi Denki Kabushiki Kaisha) was measured by using a Macbeth densitometer (RD-914 manufactured by Macbeth Corp.).

Appearance of recording surface

The appearance of the recording surface was evaluated with the naked eye as follows:

○: Any bar-line, streak or scratch was not found.

Δ: A few of bar-lines, streaks and scratches were formed.

x: Many bar-lines, streaks and scratches were formed.

TABLE 1

| No. | Bekk smoothness of recording layer | Color density | Appearance of recording surface |
|---|---|---|---|
| Example | | | |
| 1 | 3200 | 1.54 | ○ |
| 2 | 3500 | 1.53 | ○ |
| 3 | 3100 | 1.53 | ○ |
| 4 | 4200 | 1.54 | ○ |
| 5 | 2000 | 1.53 | ○ |
| 6 | 2500 | 1.54 | ○ |
| 7 | 4000 | 1.53 | ○ |
| 8 | 2800 | 1.52 | ○ |
| 9 | 3200 | 1.53 | ○ |
| Comparative Example | | | |
| 1 | 7800 | 1.54 | X |
| 2 | 7300 | 1.55 | X |
| 3 | 7200 | 1.55 | X |
| 4 | 6200 | 1.53 | Δ |
| 5 | 7000 | 1.53 | X~Δ |
| 6 | 9000 | 1.52 | X |
| 7 | 7800 | 1.54 | X |
| 8 | 10000 | 1.52 | X |
| 9 | 9100 | 1.54 | X |
| 10 | 7200 | 1.48 | X~Δ |
| 11 | 6500 | 1.50 | Δ |

As shown in Table 1, any of bar-line, streak and scratch was not found in the heat-sensitive recording materials produced by the method of the present invention.

What is claimed is:

1. A method for preparing a heat-sensitive recording material, which comprises the steps of: (1) forming a heat-sensitive recording layer on a base sheet of a plastic film or synthetic paper, wherein the heat-sensitive recording layer comprises a chromogenic material and a color developer which produces a color by thermally contacting with the chromogenic material and characterized in that the heat-sensitive recording layer is formed by applying an aqueous coating composition comprising the chromogenic material and the color developer together with a binder and a pigment with use of a coater selected from the group consisting of bar coaters, rod coaters and blade coaters to the Bekk smoothness of the heat-sensitive recording layer from 500 to 6000 seconds, and (2) forming a protective layer on the heat-sensitive recording layer, wherein the protective layer is formed by applying an aqueous coating composition on the heat-sensitive recording layer with use of a coater selected from the group consisting of bar coaters, rod coaters and blade coaters.

2. A method as defined in claim 1, wherein the protective layer is formed after adjusting Bekk smoothness of the heat-sensitive recording layer to 1,5000 to 4,500 seconds.

3. A method as defined in claim 1, wherein the pigment has an average particle size of 0.5 to 4.0 μm is in the heat-sensitive recording layer in an amount of 5 to 50% by weight based on the total solid of the heat-sensitive recording layer to adjust Bekk smoothness of the heat-sensitive recording layer to 500 to 6,000 seconds.

4. A method as defined in claim 3, wherein the pigment is at least one selected from the group consisting of kaolin, calcium carbonate, calcined kaolin and amorphous silica.

5. A method as defined in claim 1, wherein the amount of the binder in the heat-sensitive recording layer is adjusted to 5 to 60% by weight based on the total solid of the heat-sensitive recording layer to adjust Bekk smoothness of the heat-sensitive recording layer to 500 to 6,000 seconds.

6. A method as defined in claim 5, wherein the binder is a styrene-butadiene resin or urethane resin.

7. A method as defined in claim 1, wherein the base sheet is a drawn plastic film of polypropylene, polyester, polyamide or polycarbonate; or synthetic paper made by a film method with use of polypropylene, polyester, polyamide or polycarbonate.

8. A method as defined in claim 1, wherein the protective layer comprises a water-soluble resin.

* * * * *